US007717735B2

(12) United States Patent
Yasui

(10) Patent No.: US 7,717,735 B2
(45) Date of Patent: May 18, 2010

(54) ELECTRONIC APPARATUS

(75) Inventor: Satoru Yasui, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/116,891

(22) Filed: May 7, 2008

(65) Prior Publication Data

US 2009/0061676 A1 Mar. 5, 2009

(30) Foreign Application Priority Data

Aug. 28, 2007 (JP) ..... 2007-221546

(51) Int. Cl.
*H01R 3/00* (2006.01)

(52) U.S. Cl. ..... 439/490

(58) Field of Classification Search ..... 439/490
See application file for complete search history.

(56) References Cited

U.S. PATENT DOCUMENTS 5,704,802 A * 1/1998 Loudermilk ..... 439/490
5,797,767 A 8/1998 Schell
6,174,194 B1 * 1/2001 Bleicher et al. ..... 439/490
6,428,361 B1 * 8/2002 Imschweiler et al. ..... 439/676
6,699,065 B1 * 3/2004 Espenshade et al. ..... 439/490

FOREIGN PATENT DOCUMENTS

JP H10-134897 A 5/1998
JP 2000-30811 A 1/2000
JP 2003-243097 A 8/2003

* cited by examiner

*Primary Examiner*—Renee S Luebke
*Assistant Examiner*—Larisa Tsukerman
(74) *Attorney, Agent, or Firm*—Knobbe Martens Olson & Bear, LLP

(57) ABSTRACT

According to an aspect of the present invention, there is provided an electronic apparatus including: a housing; a circuit board that is housed in the housing; a connector that is mounted on the circuit board and has a jack opening disposed to be exposed from the housing; and an LED unit that is detachably installed on the connector.

2 Claims, 6 Drawing Sheets

ELECTRONIC APPARATUS

CROSS-REFERENCE TO RELATED APPLICATIONS

This application is based upon and claims the benefit of priority from Japanese Patent Application No. 2007-221546, filed Aug. 28, 2007, the entire contents of which are incorporated herein by reference.

BACKGROUND

1. Field

An aspect of the present invention relates to an electronic apparatus including a connector provided with an LED.

2. Description of the Related Art

As a modular jack connector of a notebook PC for connecting an LAN cable, the connector with a built-in LED for visualizing an LAN connecting situation has widely spread.

In general, a heat resistant temperature of an LED portion of the modular jack connector is lower than that in other portions. For this reason, for example, the LED provided in the modular jack connector may not be turned on when the modular jack connector is subjected to reflow mounting. In order to prevent the failure, it is necessary to perform the reflow mounting and to then solder the modular jack connector to a substrate individually. In the case in which the LED cannot be turned on, moreover, it is necessary to remove the whole modular jack connector from the substrate and to solder a new modular jack connector. This causes a great deal of time and labor for a repair.

JP-2000-30811-A discloses a connector assembly in which an LED housing is provided and attached to a circuit board separately from the modular jack housing. There is employed a structure in which an LED module is attached to the modular jack housing and the LED module has LED housings for mounting respective LEDs.

In the system, however, a leg of a conductor of the LED housing is attached to a printed circuit board. For this reason, there is a problem in that the LED housing can be attached and removed in only a manufacture of a connector and the LED housing can be neither attached nor removed after a connector is mounted on the printed circuit board. Therefore, it is impossible to replace only the LED when the LED cannot be turned on and it is necessary to remove the whole connector from the substrate in order to perform a repair.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, an electronic apparatus includes: a housing; a circuit board that is housed in the housing; a connector that is mounted on the circuit board and has a jack opening disposed to be exposed from the housing; and an LED unit that is detachably installed on the connector.

An embodiment will be described below with reference to the drawings.

Figure 1:
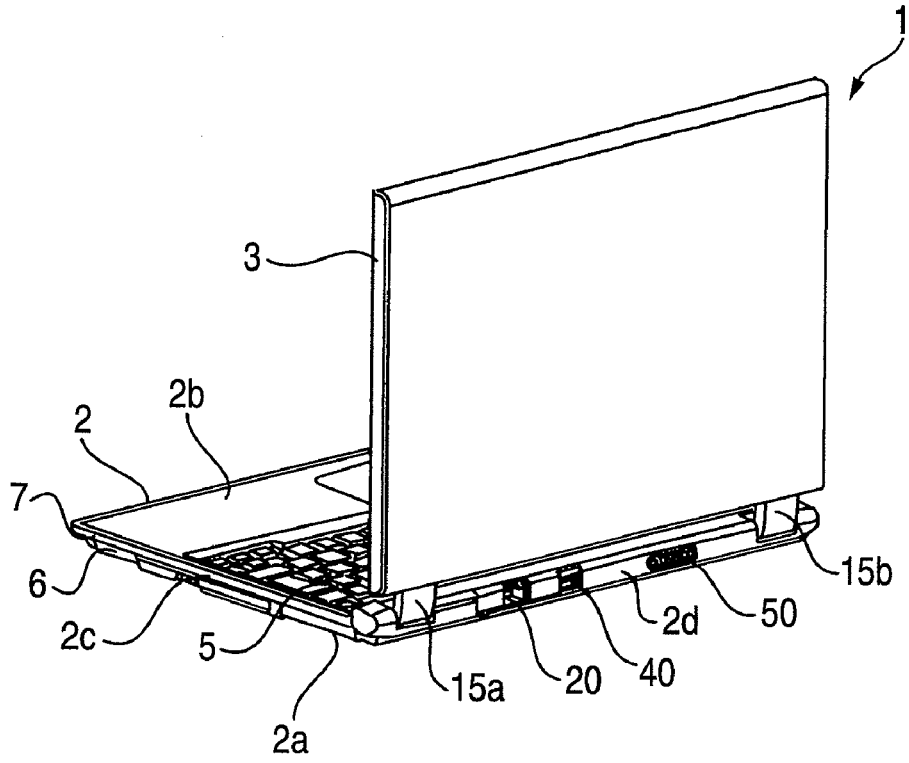
FIG. 1 is an exemplary perspective view showing an electronic apparatus according to an embodiment.
Figure 2:
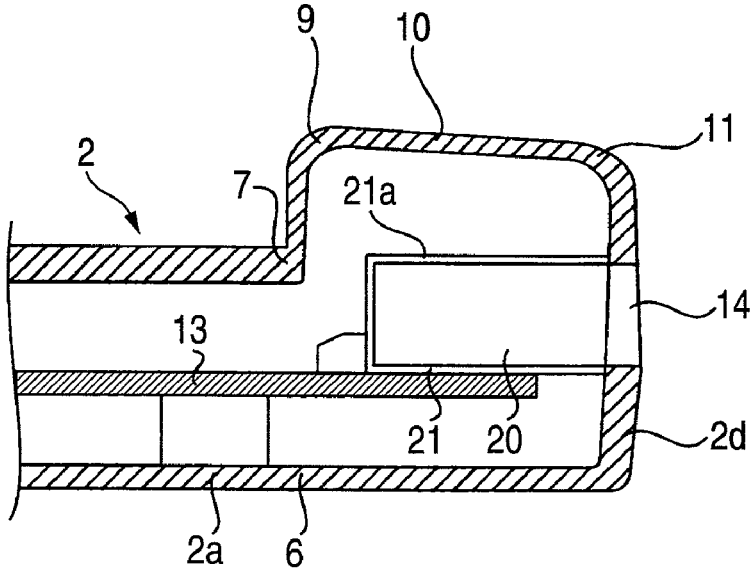
FIG. 2 is an exemplary sectional view showing the vicinity of a connector of the electronic apparatus according to the embodiment.

FIG. 1 is a perspective view showing an electronic apparatus according to the embodiment. FIG. 2 is a sectional view showing the vicinity of a connector of the electronic apparatus according to the embodiment.

An electronic apparatus 1 includes a body unit 2 and a display unit 3. The body unit 2 is formed by a synthetic resin and has an internal face plated to have an electrical conductivity. Alternatively, the body unit 2 may be formed of a metal, such as magnesium. The body unit 2 takes a shape of a flat box which has a bottom wall 2*a*, an upper wall 2*b*, left and right side walls 2*c* and a rear wall 2*d*. The upper wall 2*b* supports a keyboard 5.

The body unit 2 has a base 6 having the bottom wall 2*a* and a top cover 7 having the upper wall 2*b*. The top cover 7 covers the base 6 from above and is detachably supported on the base 6. An upward bulged portion 9 is formed on a rear end of the upper wall 2*b* of the top cover 7. The bulged portion 9 is extended in a transverse direction of the body unit 2 behind the keyboard 5. The bulged portion 9 has an upper end wall 10. The upper end wall 10 is linked to an upper end of the rear wall 2*d* of the body unit 2 and is inclined slightly downward in a rearward direction of the body unit 2. A corner portion 11 defined by the upper end wall 10 and the rear wall 2*d* is curved like an arc.

As shown in FIG. 2, the body unit 2 accommodates a printed circuit board 13. The printed circuit board 13 is supported on the bottom wall 2*a* of the base 6. A rear end of the printed circuit board 13 being positioned below the bulged portion 9.

A plurality of connectors, for example, an LAN connector 20, a USB connector 40 and an RGB connector 50 are mounted on the rear end of the printed circuit board 13. As shown in FIG. 1, the connectors are arranged at an interval in the transverse direction of the body unit 2. The respective connectors are positioned below the bulged portion 9 and are exposed in a rearward part of the body unit 2 through a plurality of opening portions 14 which is formed on the rear wall 2*d*.

The LAN connector 20 has an outer peripheral face covered with a metallic case 21. The case 21 has a flat upper face 21*a*. The upper face 21*a* of the case 21 is almost horizontal and is opposed to the upper end wall 10 of the bulged portion 9.

As shown FIG. 1, the display unit 3 takes a shape of a flat box which has an almost equal size to that of the body unit 2, and accommodates a liquid crystal display panel which is not shown. The display unit 3 has a pair of leg portions 15*a* and 15*b*. The leg portions 15*a* and 15*b* are supported on a rear end of the body unit 2 through a hinge which is not shown. The display unit 3 is rotatable between a closing position in which it is laid over the body unit 2 to cover the keyboard 5 and an opening position in which it is raised from the body unit 2 to expose the keyboard 5.

Figure 3:
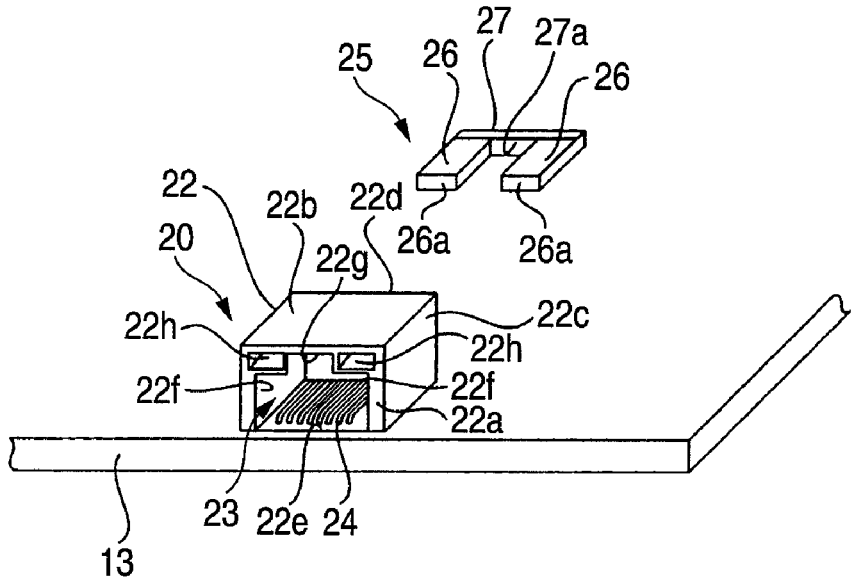
FIG. 3 is an exemplary perspective view showing a front of the connector of the electronic apparatus according to the embodiment.
Figure 4:
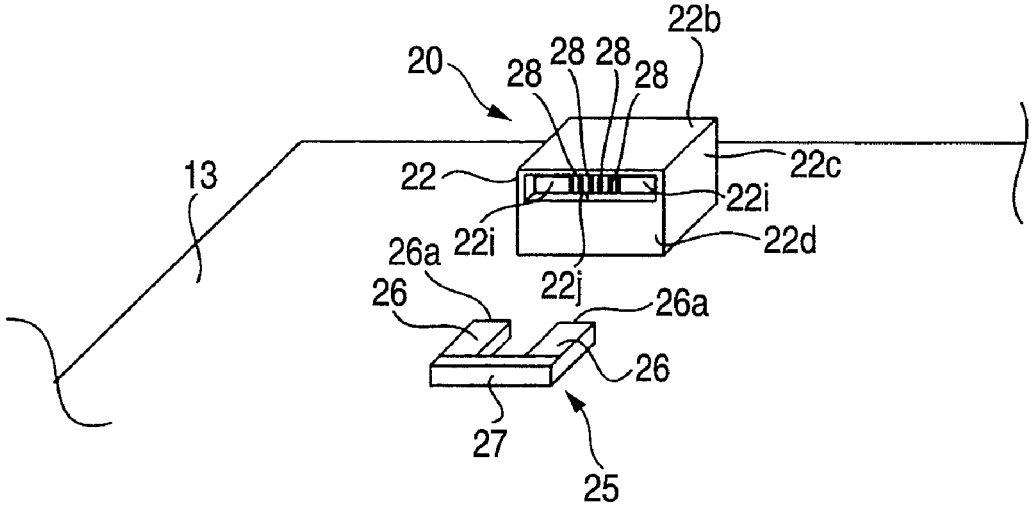
FIG. 4 is an exemplary perspective view showing a back of the connector of the electronic apparatus according to the embodiment.
Figure 5:
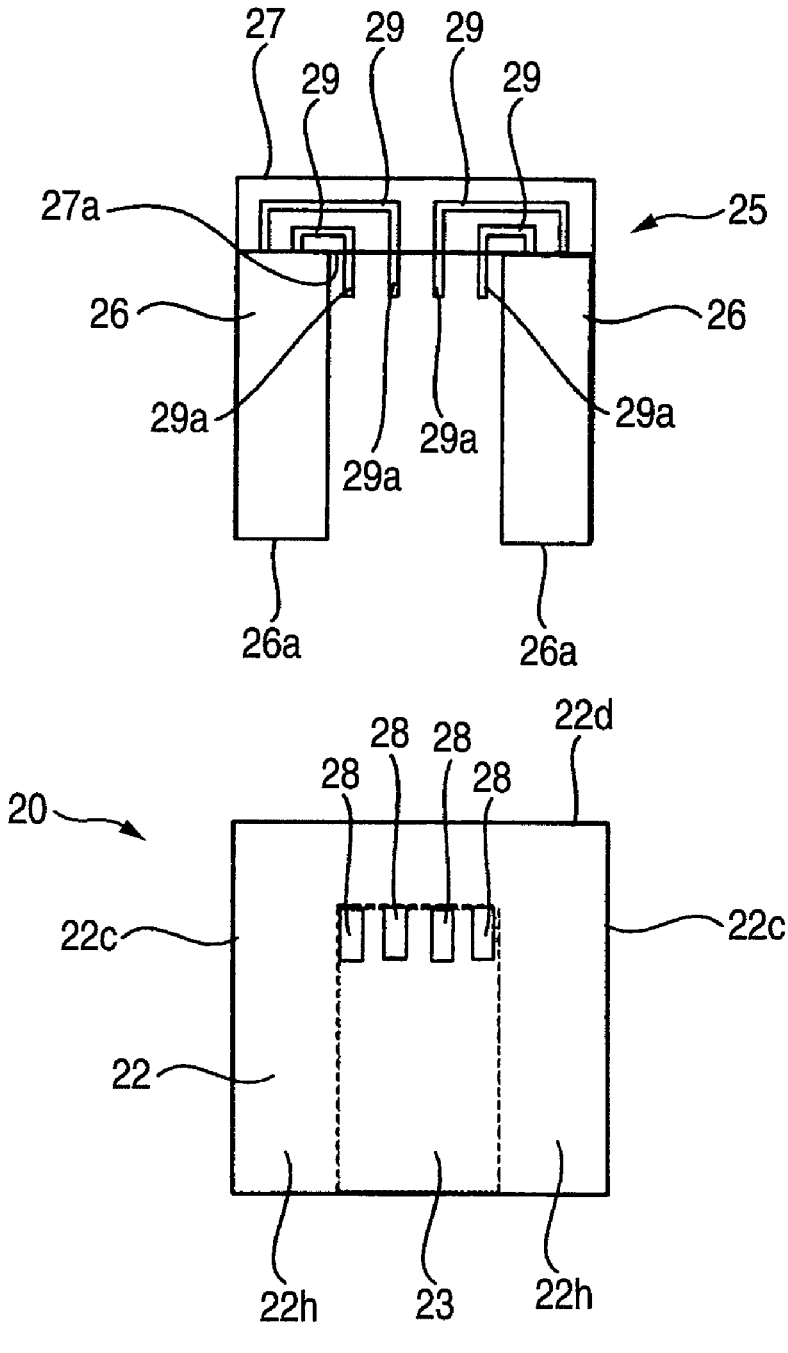
FIG. 5 is an exemplary view showing a state in which the connector and a holding member according to the embodiment are detached.
Figure 6:
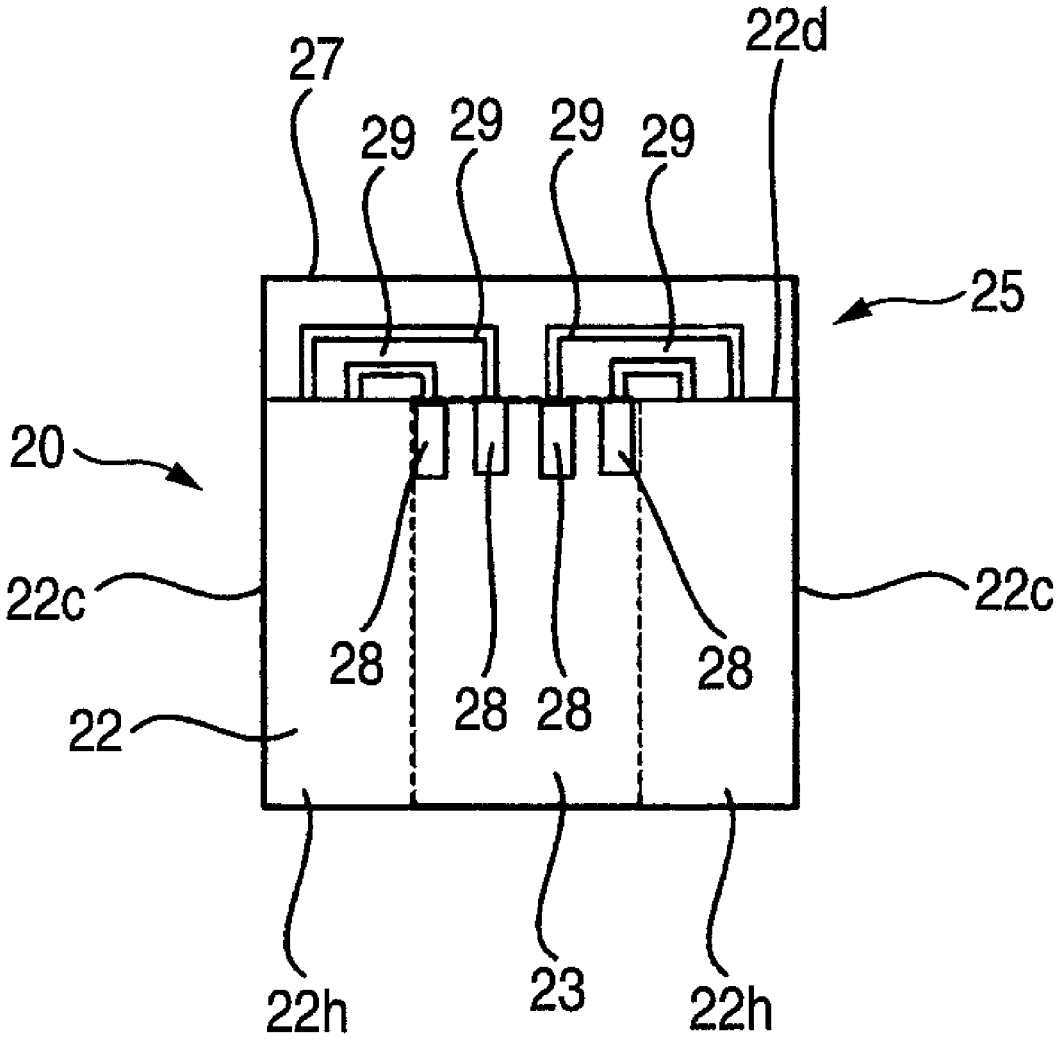
FIG. 6 is an exemplary view showing a state in which the connector and the holding member according to the embodiment are attached.

The connector of the electronic apparatus according to the embodiment will be described with reference to FIGS. 3 to 6. FIG. 3 is a perspective view showing a front of the connector of the electronic apparatus according to the embodiment. FIG. 4 is a perspective view showing a back of the connector of the electronic apparatus according to the embodiment. FIG. 5 is a view showing a state in which the connector and a holding member according to the embodiment are detached. FIG. 6 is a view showing a state in which the connector and the holding member according to the embodiment are attached.

Various electronic components and the connectors are mounted on the printed circuit board 13, and FIGS. 3 and 4 mainly show the LAN connector 20 and the other electronic components are not shown. In FIGS. 5 and 6, the printed circuit board 13 is not shown and only the LAN connector and the LED unit are shown.

A body 22 of the LAN connector 20 has a front face 22*a*, an upper face 22*b*, a side face 22*c*, a back face 22*d*, and a bottom face 22*e*. The LAN connector 20 further has an internal side face 22*f* and an internal upper face 22*g*, and the internal side face 22*f* and the internal upper face 22*g* are defined to form an opening portion 23 which is adapted to a shape of the LAN cable. The opening portion 23 of the LAN connector 20 is provided in such a manner that the LAN cable can be inserted from an outside through the opening portion 14 of the body unit 2. A plurality of terminals 24 is arranged on the bottom face 22*e* of the LAN connector 20 so as to come in contact with a terminal of the LAN cable when the LAN connector 20 is inserted.

The LAN connector 20 has a cavity portion 22*h*, and an LED 26 of an LED unit 25 is inserted into the cavity portion 22*h*. The cavity portion 22*h* is provided corresponding to the number of the LEDs 26 provided in the LED unit 25. In the embodiment, the LED unit 25 has two LEDs 26 and a holding member 27 for holding the LED 26. The holding member 27 can be molded by plastic, for example. The LED unit 25 can be attached/detached to/from the LAN connector 20 and the LED unit 25 can be inserted through an inserting port 22*i* provided on the back 22*d* of the LED connector 20.

When the LED unit 25 is inserted into the LAN connector 20, at least a front face 26*a* of the LED 26 is exposed from the front face 22*a* side with the opening portion 23 of the LED connector 20. By checking a lighting state of the LED 26 exposed from the front face 22*a* of the LED connector 20, a user can also recognize a communicating situation of the electronic apparatus 1. The back face 22*d* of the LED connector 20 is provided with a socket 28 for conducting the LED unit 25 to the LED connector 20. When a pin 29 of the LED unit 25 is pressed into the socket 28 so that the pin 29 is fitted in the socket 28, an electrical connection to the LED unit 25 can be maintained so that the LED 26 can be turned on. The pin 29 to be fitted in the socket 28 is provided in the holding member 27 of the LED unit 25. The pin 29 has an end 29*a*, and the end 29*a* protrudes from a front face 27*a* of the holding member 27 of the LED unit 25.

A support portion 22*j* having a size adapted to the holding member 27 is provided on the back face 22*d* of the LAN connector 20 in such a manner that the LED unit 25 is fixed to the LAN connector 20 when the LED unit 25 is inserted into the LAN connector 20.

In the embodiment, in the connector provided with the LED, the LED unit 25 is provided as a separate component. Consequently, it is possible to easily repair the LED connector by detaching and replacing the LED unit 25, when the LED can not be turned on, for example. By individually attaching the LED which is less resistant to heat later also in a manufacture, moreover, it is possible to mount the connector through reflow mounting. Furthermore, it is possible to considerably shorten a time required for a manual soldering step by an operator and a repair. As a result, it is possible to enhance a productivity. According to the embodiment, it is possible to provide an electronic apparatus including a connector which can prevent such a failure that the LED cannot be turned on, and can be repaired more easily even after mounting on a printed circuit board.

Figure 7:
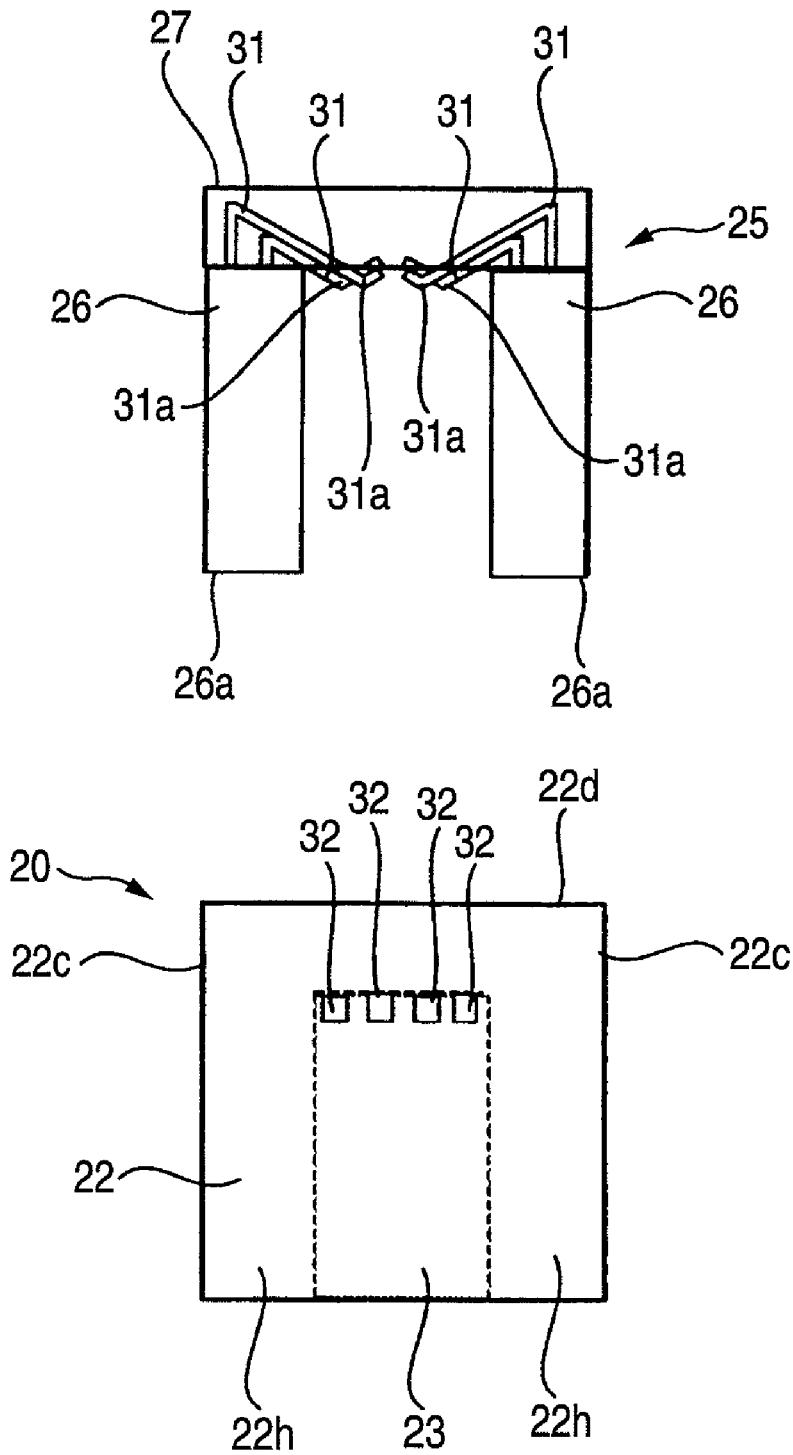
FIG. 7 is an exemplary view showing a state in which a connector and a holding member according to another embodiment are detached.
Figure 8:
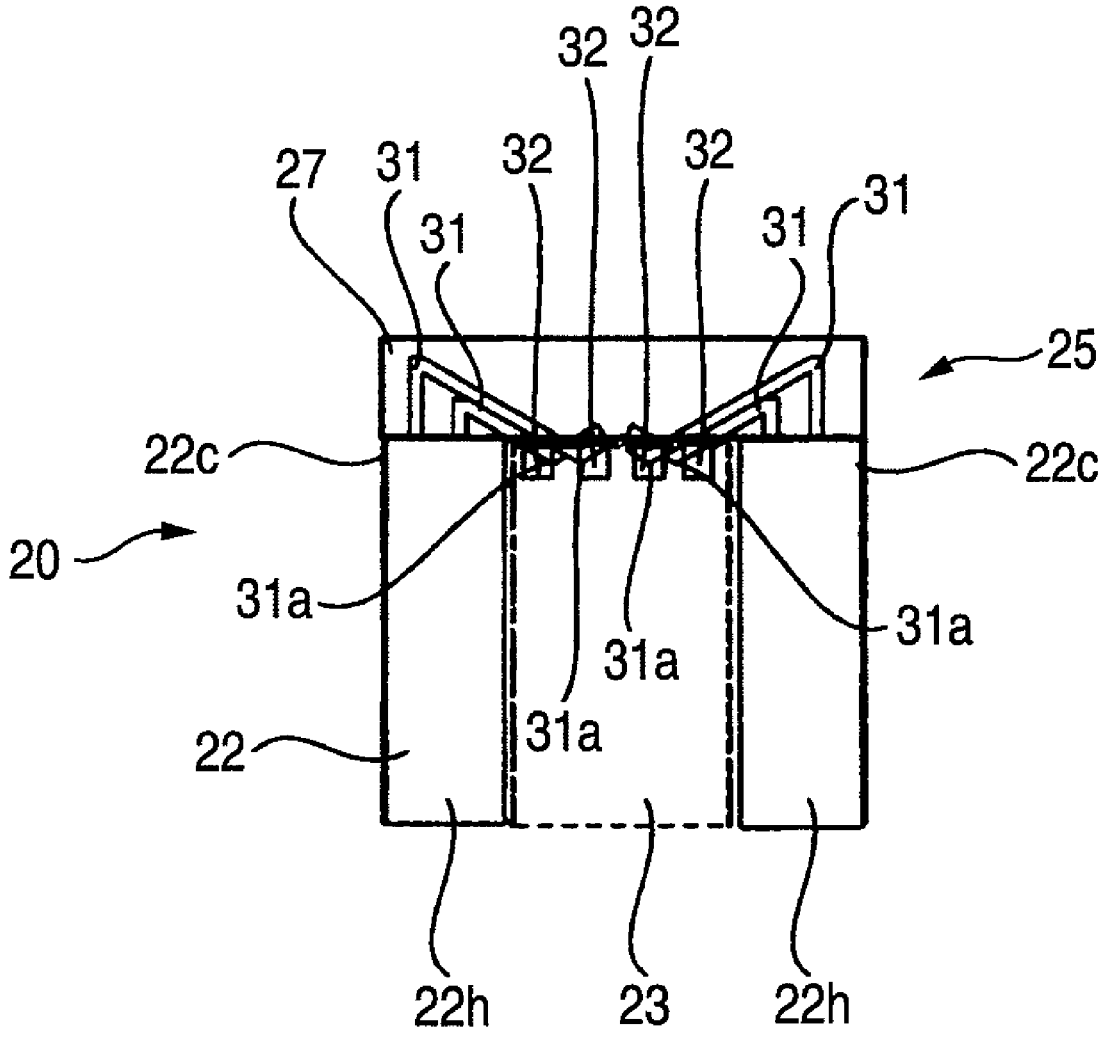
FIG. 8 is an exemplary view showing a state in which the connector and the holding member according to another embodiment are attached.

FIG. 7 is a view showing a state in which a connector and a holding member according to another embodiment are detached. FIG. 8 is a view showing a state in which the connector and the holding member according to another embodiment are attached. In comparison between the connector and the holding member shown in FIGS. 5 and 6 and the connector and the holding member shown in FIGS. 7 and 8, the shapes of pins of LED units and the shapes of sockets of LAN connectors are different from each other. For this reason, the other components have the same reference numerals and repetitive description will be omitted.

A socket 32 for conducting the LED unit 25 to the LED connector 20 is provided on the back face 22*d* of the LED connector 20, and a pin 31 of the LED unit 25 and the socket 32 come in contact with each other so that an electrical connection to the LED unit 25 can be maintained and the LED 26 can be turned on. The pin 31 has an end 31*a* bent to take a dog-leg shape, and the end 31*a* comes in contact with the socket 32. The pin 31 is provided in such a manner that the end 31*a* is exposed from the front face 27*a* of the holding member 27 in the LED unit 25. To prevent the pins 31 from coming in contact with one another, for example, a position in the vertical direction of each of the pin 31 is adjusted.

Even if the pin and the socket in the LED unit take the shapes shown in FIGS. 7 and 8, it is possible to easily repair the LED connector by detaching and replacing the LED unit 25 when a failure is caused, for example, the LED cannot be turned on in the same manner as in the case. By individually attaching the LED which is less resistant to heat later also in a manufacture, moreover, it is possible to mount the connector through reflow mounting.

In any of the embodiments described above, it is possible to attach the LED after mounting the connector through the reflow mounting. Consequently, it is possible to increase the number of components which can be subjected to the reflow mounting and to decrease the number of steps, and to improve a cost and a yield. In any case, it is not necessary to solder a contact of the LED and the connector. Therefore, it is possible to simplify the repair more greatly.

According to an aspect of the present invention, there is provided an electronic apparatus including a connector which can prevent such a failure that an LED cannot be turned on, and can be repaired more easily even after mounting on a printed circuit board.

The invention is not restricted to the embodiments without departing from the scope of the invention and various changes can be made.

What is claimed is:

1. An electronic apparatus comprising:

a housing;

a circuit board that is housed in the housing;

a connector that is mounted on the circuit board and has a jack opening outwardly exposed from the housing; and an LED unit that is detachably installed on the connector, the LED unit comprising an LED that emits a light and a holder that holds the LED;

wherein the connector comprises, an insertion port configured to receive the LED, a support portion configured to support the holder when the LED is inserted into the insertion port, and a socket that is disposed opposite the jack opening portion, wherein the LED unit comprises a pin configured to be electrically connected to the socket when the LED is inserted into the insertion port, and wherein the holder comprises a front face that faces the socket, wherein the pin is disposed on the front face and is configured to be pressed into the socket.

2. An electronic apparatus comprising:

a housing;

a circuit board that is housed in the housing;

a connector that is mounted on the circuit board and has a jack opening outwardly exposed from the housing; and an LED unit that is detachably installed on the connector, the LED unit comprising an LED that emits a light and a holder that holds the LED;

wherein the connector comprises, an insertion port configured to receive the LED, a support portion configured to support the holder when the LED is inserted into the insertion port, and a socket that is disposed opposite the jack opening portion, wherein the LED unit comprises a pin configured to be electrically connected to the socket when the LED is inserted into the insertion port, and wherein the holder comprises a front face that faces the socket, wherein the pin is disposed on the front face and contacts the socket.

* * * * *